US006408929B2

(12) United States Patent
Choudhury et al.

(10) Patent No.: US 6,408,929 B2
(45) Date of Patent: Jun. 25, 2002

(54) METHOD AND APPARATUS FOR THE PRODUCTION OF PRECISION CASTINGS BY CENTRIFUGAL CASTING WITH CONTROLLED SOLIDIFICATION

(75) Inventors: Alok Choudhury, Püttlingen; Harald Scholz, Frankfurt am Main; Matthias Blum, Büdingen; Georg Jarczyk, Grosskrotzenburg; Marek Gorywoda, Hanau; David Francis Lupton, Gelnhausen, all of (DE)

(73) Assignees: Ald Vacuum Technologies AG, Erlensee; W. C. Heraeus GmbH & Co. KG, Hanau, both of (DE)

( * ) Notice: Subject to any disclaimer, the term of this patent is extended or adjusted under 35 U.S.C. 154(b) by 0 days.

(21) Appl. No.: 09/849,045

(22) Filed: May 4, 2001

Related U.S. Application Data

(62) Division of application No. 08/937,995, filed on Sep. 26, 1997, now Pat. No. 6,250,366.

(30) Foreign Application Priority Data

Sep. 26, 1996 (DE) ..... 196 39 514

(51) Int. Cl.[7] ..... B22D 13/06
(52) U.S. Cl. ..... 164/338.1
(58) Field of Search ..... 164/118, 338.1

(56) References Cited

U.S. PATENT DOCUMENTS 4,033,401 A 7/1977 Wlodawer
4,953,612 A * 9/1990 Sare et al. ..... 164/102
5,950,706 A * 9/1999 Choudhury et al. ..... 164/138

FOREIGN PATENT DOCUMENTS

| | | |
|---|---|---|
| DE | 5966674 | 11/1930 |
| DE | 2427098 | 9/1975 |
| EP | 443544 | * 10/1993 |
| JP | 56-77058 | * 6/1981 |
| JP | 3-174965 | * 7/1991 |

* cited by examiner

*Primary Examiner*—Kuang Y. Lin
(74) *Attorney, Agent, or Firm*—Fulbright & Jaworski L.L.P.

(57) ABSTRACT

In the production of precision castings by centrifugal casting with controlled solidification, a melt is cast under vacuum or shield gas into a pre-heated mold (15) with a central gate (19) and several mold cavities proceeding from the gate toward the outer circumference ($D_a$) of the mold (15). To prevent the formation of shrinkholes and porous areas in the castings, to save energy, and to increase the production rate, the mold (15) is operated at temperatures which decrease from the inside toward the outside. The mold consists of a material or material combination with a coefficient of thermal conductivity lower than that of copper. Before the melt is poured, the mold (15) is heated, starting from the gate (19), by a heating device (20), which projects into the gate, so that the gate (19) reaches a temperature which is a function of the material being cast. Heating is carried out at a rate sufficient to produce a temperature Gradient of at least 100° C., preferably of 200–600° C., even more preferably of 300–500° C., between the inside circumference ($D_i$) and the outside circumference ($D_a$). The invention is used preferable for the production of precision castings of metals of the group titanium, titanium alloys with at least 40 wt. % of the titanium, and superalloys.

15 Claims, 4 Drawing Sheets

24
25
26
27
9
10
8
1
3
22
23
5
6a
28
6
7
21
15
20
34
2
34
19
Di
Da
16
17
18
11
12
4
14
13

METHOD AND APPARATUS FOR THE PRODUCTION OF PRECISION CASTINGS BY CENTRIFUGAL CASTING WITH CONTROLLED SOLIDIFICATION

This is division, of application Ser. No. 08/937,995 filed Sep. 26, 1997, now U.S. Pat. No. 6,250,366.

The invention pertains to a method for the production of precision castings by the centrifugal casting, with controlled solidification, of a melt under vacuum or shield gas into a preheated mold with a central gate and several mold cavities extending toward the outside periphery of the mold, the mold cavities being surrounded by a material or a material combination with a coefficient of thermal conductivity which is lower than that of copper.

There is an increasing demand for components of titanium or alloys containing large amounts of titanium, because these materials have a low specific weight and yet are extremely strong, provided that the specific properties of titanium are taken sufficiently into account, these properties including a high melting point and a considerable degree of reactivity at high temperatures. At its melting temperature, titanium reacts not only with reactive gases, including oxygen in particular, but also with oxides and nearly all ceramics, because these usually consist at least predominantly of oxide compounds. Because titanium has a greater affinity for oxygen, oxygen is removed from the oxides, with the result that titanium oxides are formed. Some materials which have proven to be superior for use in certain areas are listed by way of example below:

pure titanium,

Ti 6 Al 4 V,

Ti 6 Al 2 Sn 4 Zr 2 Mo,

Ti 5 Al 2.5 Sn,

Ti 15 V 3 Al 3 Cr 3 Sn

Ti Al 5 Fe 2.5

50 Ti 46 Al 2 Cr 2 Nb, and titanium aluminides.

Worthy of particular mention is the use of titanium aluminides e.g., TiAl, as materials for numerous types of components. Because of their low density, relatively high high-temperature strength, and corrosion resistance, the titanium aluminides are considered an optimum material in various areas of application. Because these materials are very difficult to shape, the only practical method of forming them is to cast them. Especially in the case of casting, however, titanium-containing metals present another set of problems, which will be discussed in greater detail below.

Some examples of ways in which titanium-containing materials are used are listed below:

valves for internal combustion engines, turbine rotors and turbine vanes, compressor rotors, biomedical prostheses (implants), and compressor housings in aircraft construction.

Both intake and exhaust valves of certain titanium alloys have been found to be extremely reliable, especially in automobile racing, with the result that thought is being given to the mass production of such valves for internal combustion machines of all types.

EP-0 443 544 B1 deals with the problem of improving the dimensional accuracy or accuracy of shape of centrifugal casting molds of copper and the removability of workpieces of titanium alloys from the molds by adding zirconium, chromium, beryllium, cobalt, and sliver as alloying elements to the copper, the sum of all alloying elements together not exceeding 3 wt. %. A comparison example in which the copper was alloyed with 18 wt. % of nickel did not lead to success. The publication in question discusses the electrical conductivity of the material but not its thermal conductivity, so that the problems involving a high quenching rate and the formation of shrinkholes and pores are not treated. On the other hand, this literature reference does discuss the disadvantages of mold materials consisting of ceramic or oxide materials.

DE 44 20 138 A1 also describes a method of the general type described above. From this document and DE 195 05 689 A1, molds for implementing such methods are known, in which at least the surfaces of the mold cavities which come in contact with the melt consist of a material selected from the group consisting of tantalum, niobium, zirconium, and/or an alloy A with at least one of these metals, i.e., materials with a thermal conductivity which is considerably less than that of copper and also with a specific heat capacity which is much less than that of copper. Insofar as base materials for these mold cavity surfaces are discussed, the base bodies consist of different metals in the case of the object of DE 44 20 138, but the condition remains fulfilled that the thermal conductivity and the heat capacity of the complete mold are lower than the corresponding values of copper. DE 195 05 689 A1 recommends materials from the group consisting of titanium, titanium alloys, titanium aluminide, graphite, and silicon nitride as base materials for the molds. These base materials have the advantage of a much lower specific weight and are therefore especially suitable for centrifugal casting molds.

With the methods and apparatuses according to DE 44 20 198 A1 an DE 195-05,689 A1, it has already become possible successfully to produce precision castings from quenching-sensitive materials on a large industrial scale. In these methods, the goal is significantly to reduce the high quenching rate, desired in the past as a way of avoiding reactions with the mold materials, and thus to reduce significantly the formation of shrinkholes, voids, pores, etc. in the castings, and especially to avoid the need for expensive reprocessing by high-pressure compaction (HIP method) and/or welding. To reduce the quenching rate even more, the two last-cited publications recommend that the molds be preheated to a minimum temperature of, for example, 800° C. For this purpose, it is provided that the mold is heated from the outside periphery; that is, the mold described in DE 44 20 138 A1 is surrounded by a heating cylinder. Because the walls of the gate must also reach the required temperature, it is necessary to heat up the entire volume of the mold to the temperature in question; and then, because the mold must also be cooled, it is necessary to cool its outside peripheryl by means of a gas with good thermal conductivity.

The known solutions are therefore energy-intensive and time-consuming, and the migration of the solidification front within the castings remains in a certain sense left to chance and/or depends to a considerable extent on the volume distribution of the castings. It is desirable for the solidification to occur in a controlled manner in the direction of the gate, so that the melt still present in that area can fill up any voids which may be forming in the casting.

The phrase "controlled solidification" is more comprehensive than the phrase "oriented solidification", because the goal is not so much to create a certain preferential direction of the individual crystals but rather to control the direction in which the solid/liquid solidification front migrates.

The book by Kurz and Samm entitled *Gerichtet erstarrte eutektische Werk stoffe* [*Eutectic Materials with Oriented Solidification*], Springer-Verlag, Berlin-Heidelberg-New York, 1975, pp. 195–198, describes how relative motion can be brought about between a beating device and an individual casting mold located coaxially inside it. No heating rate is given, and the rate at which the casting mold is moved is the same as the rate at which the solidification front of the melt migrates.

The invention is therefore based on the task of providing a method of the general type described above Which makes it possible to reduce the amount of energy required and to achieve shorter cycle times and which also promotes solidification from the outside toward the inside, that is, in the direction of the gate.

According to the invention, the task described above is accomplished in conjunction with the method described above in that, before the melt is poured, the mold is heated, starting from the gate, until the gate reaches a temperature which is a function of the material being cast, the heating being carried out at a rate sufficient to produce a temperature gradient of at least 100° C. between the inside periphery and the outside periphery of the mold, the temperatures falling from the inside toward the outside.

The fundamental idea of the invention is based on a synergistic effect of the mold material and the heating direction. The use of a mold known in and of itself made of a material or a material combination with a coefficient of thermal conductivity lower than that of copper makes it possible, by heating the mold from only one side, to develop a very steep temperature gradient, the steepness of the gradient obviously also depending on the amount of heating power applied, the mass to be heated, and the heat losses in the direction of the unheated surfaces.

Heating the mold by starting from the gate and proceeding outward, which is the reverse of the state of the art, has the effect that the highest mold temperature is reached in the area of the walls of the gate, which means that the temperature, gradient decreases from the inside toward the outside. This has the quite considerable advantage that, during centrifugal casting, the walls of the mold which the overheated melt contacts at the end of its journey are colder than those which it contacts just before all of the melt has been poured. The solidification front therefore migrates—in a controlled manner—from the outer end of the mold cavities or from the outside periphery of the mold toward the gate. As a result, melt still present in the gate can flow into the cavities to prevent the formation of shrinkholes, pores, etc.

The optimum temperature to which the walls of the gate are heated depends on or is determined by the material, but it can also be found by experiment. The most important point is that this temperature must have a falling gradient in the direction of the outside periphery of the mold, so that the effect described above is achieved.

It is especially advantageous for the temperature gradient to be adjusted to a value of 200–600° C., preferably to a value of 300–500° C.

When the method is used to produce precision castings of metal selected from the group titanium, titanium alloys with at least 40 wt. % of titanium, and superalloys, it is especially advantageous for the temperature of the walls of the gate to be adjusted to values of 600–1,000° C. and for the temperature of the outside periphery of the mold to be adjusted to values of 300–600° C.

It is also advantageous, when precision castings with different cross sections are being made, for the ends with the larger cross sections to be arranged pointing toward the gate.

Arranging the cavities this way in space is disadvantageous with respect to the most efficient utilization of the volume of a centrifugal casting mold, but the inward-pointing position of the ends with the larger cross sections reinforces the desired course of the solidification process, because these ends also have correspondingly larger volumes, and thus more liquid melt is available there for a longer period of time than in the narrower areas of the castings.

The invention also pertains to an apparatus for implementing the method described above, this apparatus being provided with a melting and casting device and with a chamber, in which a rotating mold with a central gate and several mold cavities extending from the gate toward the outer periphery of the mold and a heating device for preheating the mold are installed, the mold being made of a material or a material combination with a coefficient of thermal conductivity lower than that of copper.

To accomplish the same task, an apparatus according to the invention is characterized in that it has a device for producing relative motion between the heating device and the gate.

The heating device can advantageously be designed as a resistance heating body. It can be, for example, a hollow cylinder of graphite, which is slotted in such a way as to create a meander and which can be heated by the passage of current directly through it. A resistance heating body of this kind can be made appropriately narrow, so that it can be introduced into the gate. It is also possible, however, to design the heating device as an induction coil.

Molds such as those described in DE 4,420,138A1 and DE 195-05,689A1 can be used. As part of a further elaboration of the invention, however, it is especially advantageous for the mold to consist of stacks of forms arranged in several planes, the forms being provided with shoulders, by means of which they can be held on sector-shaped supports, after the forms and the supports have been arranged each in their own plane between spacer rings and after the stack of forms, supports, and spacer rings has been clamped by means of tension rods to a support plate, which is connected in a torsion-proof manner to the rotational drive unit.

A mold of this type is thus designed in modular fashion; that is, the forms can be replaced bad others with different mold cavities without the need to keep complete disks with their machined-in mold cavities in stock, as is the case in accordance with the state of the art.

It is also advantageous for the stack of forms, supports, and spacer rings to be surrounded by a clamping body, especially when the clamping body is made up of individual clamping rings, which overlap each other partially in the axial direction.

Here the object of the invention offers yet another special advantage, both with respect to the management of the method and also with respect to the apparatus or mold.

In the case of a centrifugal casting mold, the maximum radial and tangential tensile stresses occur at the outer periphery of the mold. They are a function of the diameter and rotational speed of the mold. On the one hand, it is desirable to use the highest possible rpm's in order to produce a dense structure; for example, in the case of a mold with an outside diameter of approximately 500 mm, a speed in the range of approximately 800 rpm would be used. Calculations based on the mold materials in question, however, have shown that molds with high outside temperatures according to the state of the art in the dimensions cited can at best be operated at a maximum of 500 rpm. The creation, according to the invention, of a temperature gradient which decreases from the inside toward the outside, however, leads to the additional advantage that, because of the much greater strength of the mold materials at these temperatures, it is possible to work at much higher rotational speeds. For example, for a mold with the indicated dimensions, it is possible to work at 800 rpm or more, as a result of which the structure of the precision casting can be significantly improved. Simultaneously, the danger of the deformation of the mold at the outer periphery is significantly reduced.

Thus, for example, materials such as 800 H (iron-based alloy with 21% chromium and 32% nickel) or 80 A (nickel-based alloy with 19.5% chromium, 2.5% titanium, and 1.3% aluminum) can be used for the clamping body or clamping rings described above to clamp the supports and spacer rings. These are relatively inexpensive construction materials for machinery. The actual forms or form halves can consist of niobium, tantalum, zirconium, and/or alloys the reof, but they can also consist of alloys of these metals with additional metals or of base bodies with appropriate surface coatings or of shell-shaped liners of these materials.

BRIEF DESCRIPTION OF THE INVENTION

An exemplary embodiment of the object of the invention is explained in greater detail below on the basis of the FIGS. 1–6:

DETAILED DESCRIPTION

Figure 1:
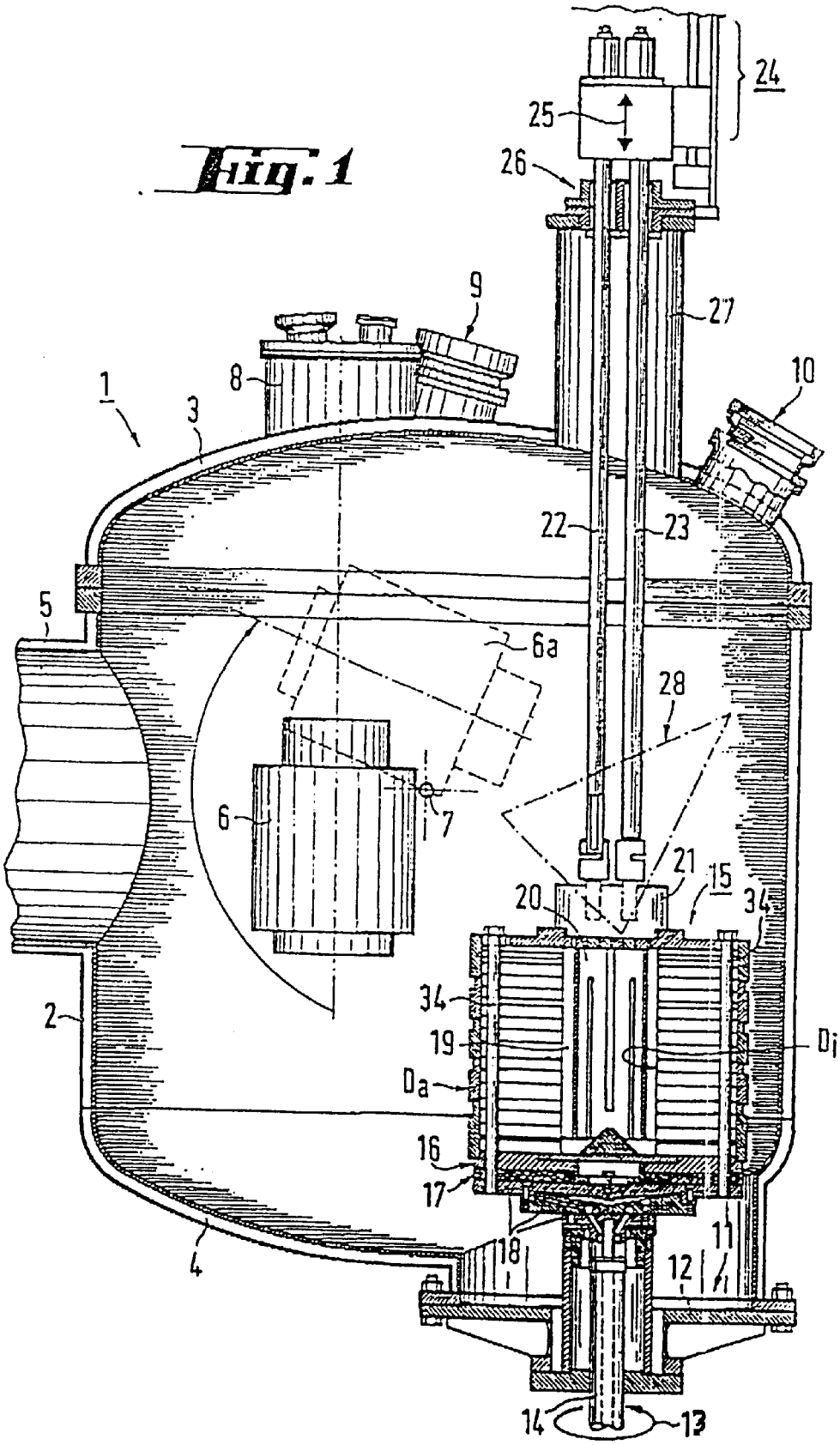
FIG. 1 shows a vertical cross section through the essential parts of a complete apparatus.

FIG. 1 shows a gas-tight chamber 1 with a cylindrical jacket 2, a removable cover 3, and a floor 4; the chamber is connected by a suction port 5 to a set of vacuum pumps (not shown). Chamber 1 can be flooded with an inert gas through a line (not shown).

In chamber 1, there is a melting and casting device 6, which is designed as an inductively heated, cold-wall crucible known in and of itself, which can be tipped into the position 6*a* shown in broken line to empty it. For this purpose, a tipping axis 7 is provided, which designed to serve simultaneously as a coaxial pass-through for melting current and cooling water. Above the melting position, there is a loading opening 8, which can be elaborated into a charging device by the addition of charging valves (not shown). Viewing windows 9, 10 make it possible to keep the melting and casting process under observation.

Melting and casting device 6 can also be housed in a separate chamber (now shown), which is upstream of chamber 1 and from which the melt is transferred into chamber 1. Melting and casting device 6 can also be followed in this case by several chambers containing heating devices 20 and molds 15, which can be arranged either in a row or in a circle or part of a circle around melting and casting device 6. In such a case, the mold can be heated in one chamber; the melt can be poured into the mold in another chamber; and the mold can be cooled in yet another chamber, so that, in the optimum case, melting an casting device 6 can be kept in continuous operation.

Melting and casting device 6 can also be designed as a cold-wall crucible which can move sideways and which has a closable discharge opening for the melt in the floor, which can be located above the mold. Arrangements such as this, although not movable, are described and illustrated in DE 44 20 138A1 and DE 195 05 689.

In floor 4 of chamber 1 there is an opening 11 with a cover plate 12, on which a rotary drive 13, merely suggested here, with a shaft 14 for a mold 15, is mounted. The mold is designed as a centrifugal casting mold; it is described in greater detail below on the basis of FIGS. 2 and 3. Mold 15 has a support plate 16, which is attached to a rotating table 18 with thermal insulation 17 inserted in between, the table being equipped with cooling channels (not referenced) for a water cooling system, where the cooling water is supplied and carried away through shaft 14.

Mold 15 has a gate 19, into which a heating device 20 is introduced, which is designed as a hollow graphite cylinder, with slots in it to form a meander. Heating device 20 extends over the entire length or depth of gate 19 and hangs from a coupling piece 21, which is connected in turn by way of two rods 22, 23, which also serve a feed lines for current and cooling water, to a motion drive 24, the drive motor of which is not shown. As a result, heating device 20 can be raised and lowered in the direction of double arrow 25. Rods 22, 23 pass in a gas-tight manner through a double slide-through seal 26, which is mounted on the upper end of a vertical pipe connector 27, into which heating device 20 can be retracted at least partially. A flow guide for the melt, indicated in broken line, is provided above mold 15. A coaxial rod, the flow routes of which are insulated from each other, can be used in place of the two rods 22, 23.

Figure 2:
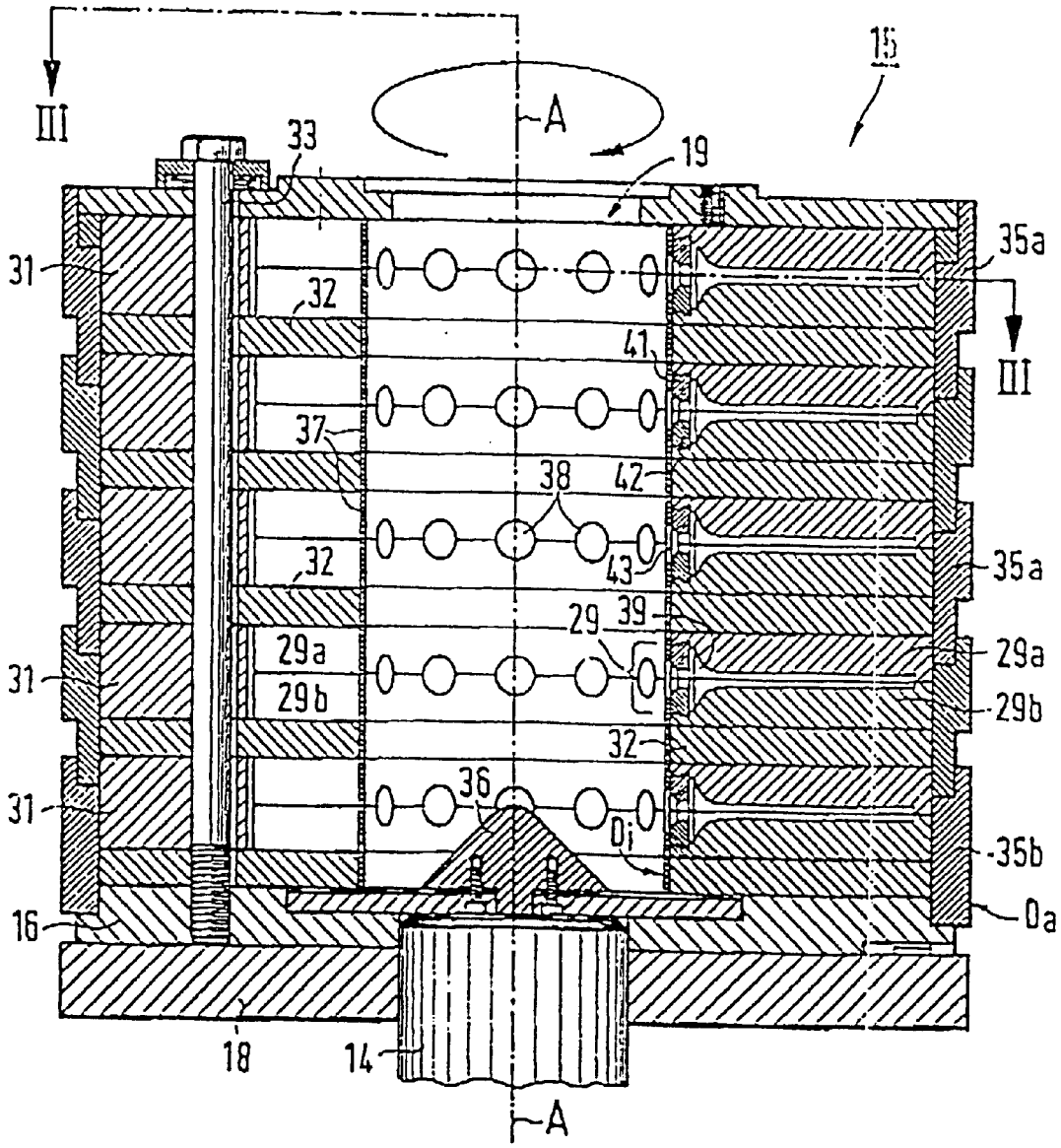
FIG. 2 shows a vertical cross section along line II—II of FIG. 3 through a mold with 5 layers for the simultaneous production of a total of 60 valves.
Figure 3:
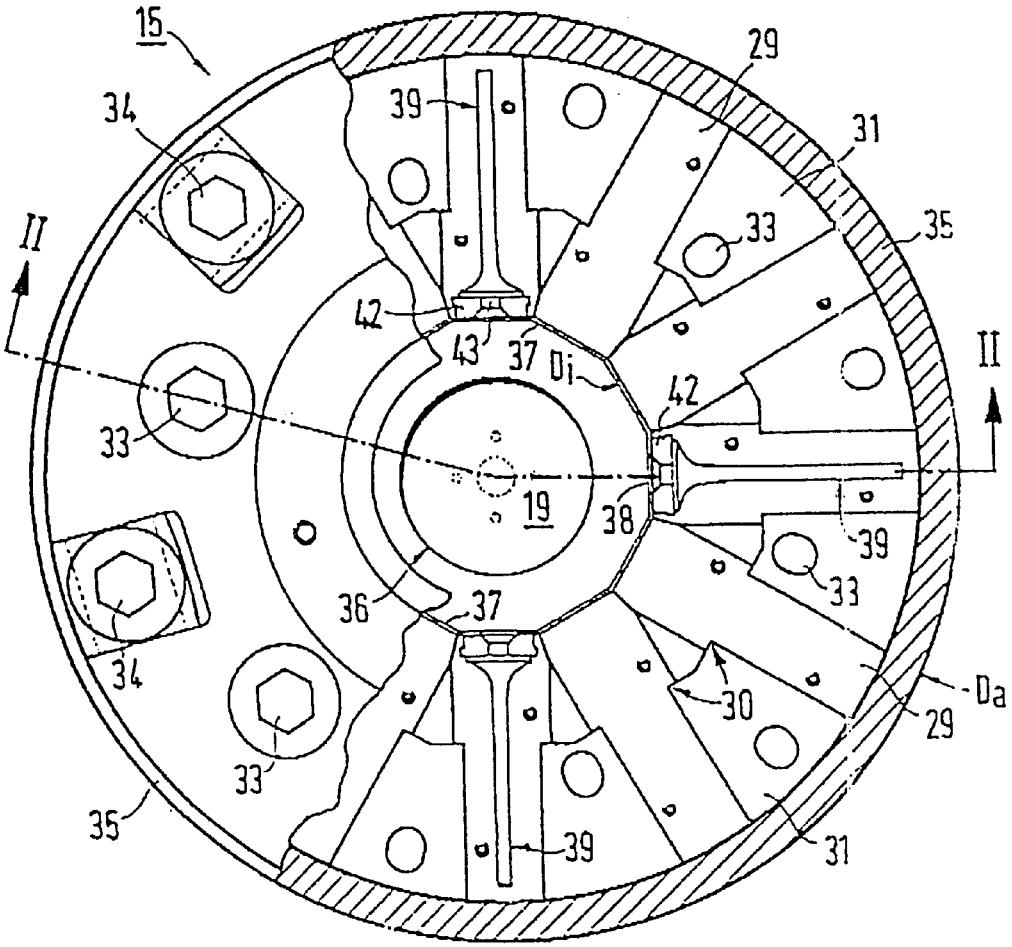
FIG. 3 shows a partial top view, and a partial horizontal cross section along line III—III of the object of FIG. 2.

As can be seen from FIGS. 2 and 3, mold 15 consists of a stack of forms 29, arranged in several planes, each of these forms consisting of two form halves 29*a*, 29*b*, which have shoulder surfaces 30, by means of which forms 29 can be held by sector-shaped supports 31. Forms 29 and supports 31 are arranged in each case in a plane between spacer rings 32, and stacks of forms 29, supports 31, and spacer rings 32 are clamped by tension rods 33 to support plate 16, already described above, which is connected to rotational drive 13. As can be seen from FIGS. 1 and 3, additional tension rods 34 also pass through the stack, these rods being screwed to rotating table 18. Tension rods 33, 34 are distributed around the lateral surfaces of two cylinders of different diameters, as illustrated in FIG. 3.

As can again be seen from FIGS. 2 and 3, the stack of forms 29, supports 31, and spacer rings 32 is surrounded by a clamping body 35 which is made up, as shown in FIG. 2, of individual clamping rings 35*a*, 35*b*, which overlap each other partially in the axial direction. Upper clamping rings 35*a* are designed with a Z-shaped cross section.

At the center of gate 19, support plate 16 is provided with a distribution body 36, concentric to the axis of rotation A—A; this body has the shape of a cone with a rounded top. As a result, the melt poured into gate 19 is deflected outward and brought up to the rotational speed of mold 15, as a result of which the surface of the melt in gate 19 assumes a parabolic shape, so that the gate does not become completely filled with melt.

Gate 19 is surrounded by mutually aligned sections 37 of polygonal pipe, which are held in a central position by spacer rings 32 and which have openings between the spacer rings 32, each of these openings communicating with one of the mold cavities 39.

Figure 5:
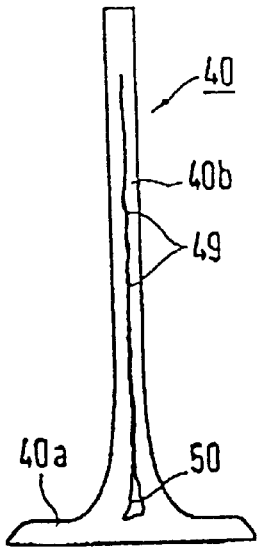
FIG. 5 shows an axial cross section through a valve for internal combustion engines, produced by a method using a mold with a high coefficient of thermal conductivity of the mold material.
Figure 6:
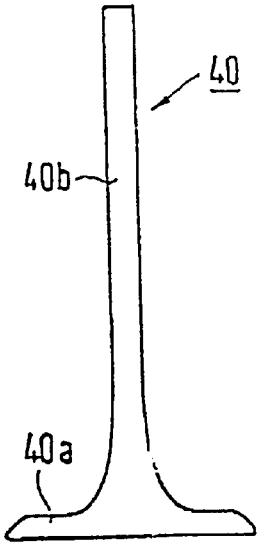
FIG. 6 shows an axial cross section through a geometrically identical valve, produced according to the method of the invention and with a mold according to the invention.

As can be seen from FIGS. 2 and 3, mold cavities 39 are designed for the production of valves 40 for internal combustion engines; the valves are shown FIGS. 5 and 6. The valves consist of a valve plate 40*a* and a shaft 40*b*. The precision castings therefore have different cross sections, and it can be seen that the ends with the larger cross section, namely, the ends with valve plates 40*a*, are facing toward gate 19.

It can also be seen from FIGS. 2 and 3 that nozzle bodies, assembled from half-rings 41, 42, are provided between pipe sections 37 and forms 29; each of these nozzle bodies frames an injection opening 43. Half-rings 41, 42 are replaceable, which means that the diameter of the injection openings can be varied and adapted to the casting conditions.

The mold has an inside circumference $D_i$ and an outside circumference $D_a$, where D stands for diameter, and the circumference can be calculated from it.

Figure 4:
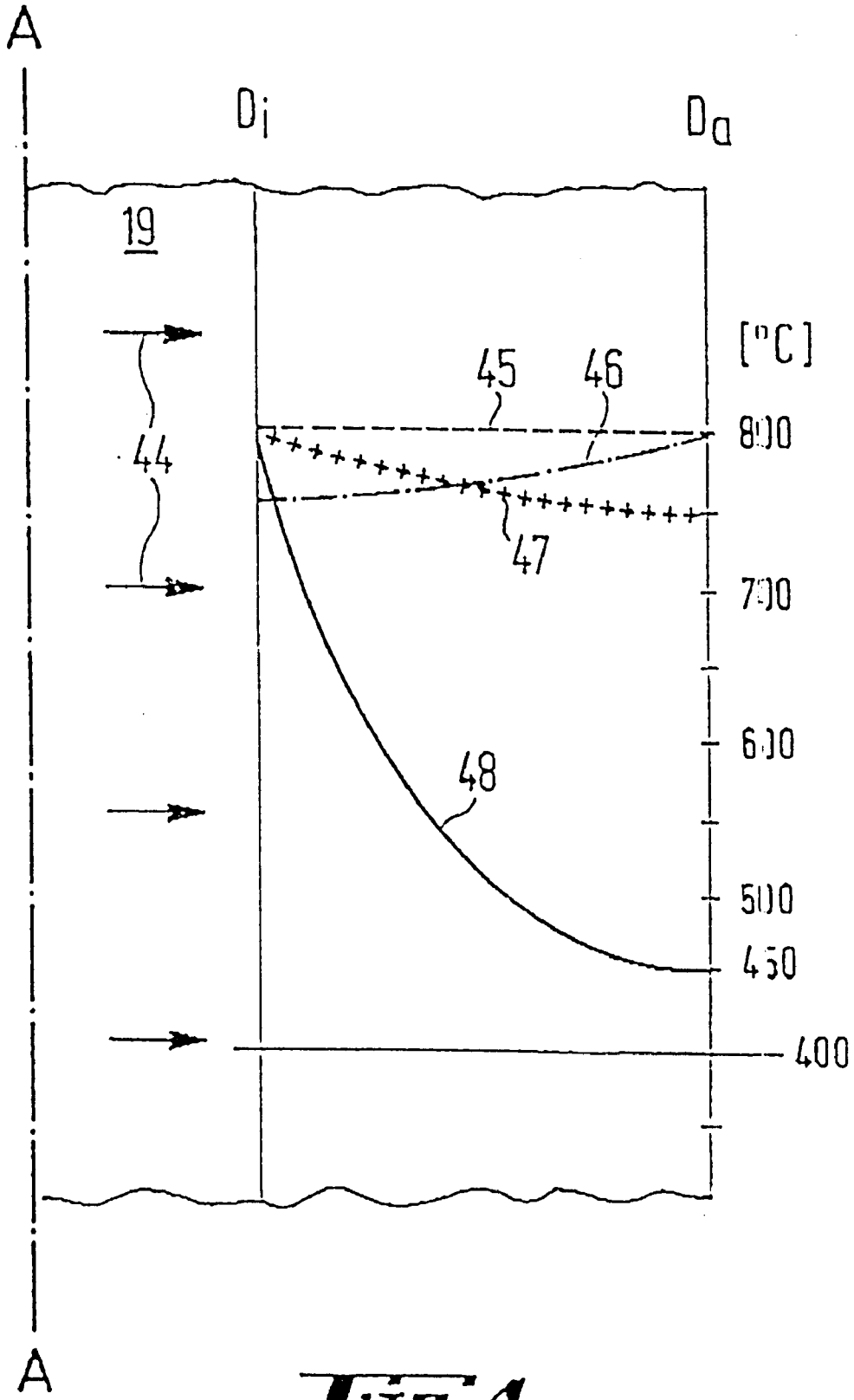
FIG. 4 shows a diagram with various temperature curves between the inside diameter and the outside diameter of the mold according to FIG. 2.

FIG. 4 now shows various curves of the change in temperature between the inside circumference $D_i$ and the outside circumference $D_a$ The thermal radiation from heating body 20 is indicated by horizontal arrows 44. Broken line 45 shows the temperature curve within the mold and along forms 29 for the case in which the forms are made of material with good thermal conductivity, which thus makes it possible for the temperature to become equalized between the inside and the outside. Dash-dot line 46 shows the temperature curve for the case in which the mold is heated from the outside and in which the mold is made of a material with a good coefficient of thermal conductivity such as copper, for example. Line 47, consisting of crosses, shows the relationships which exist when the heating direction is reversed, namely, in the direction of arrows 44 from the inside to the outside. The material involved is still one with relatively good thermal conductivity such as copper, so that a relatively very high outside temperature is reached.

Line 48 now illustrates the relationships as they exist for the object of the invention, namely, With strong heating in the direction of arrows 44 from the inside out, that is, proceeding from gate 19. As a result of the relatively rapid heating in conjunction with a mold made of a material with less efficient thermal conductivity than copper and in conjunction with the increase in the mass of mold 15 toward the outside, a much steeper temperature gradient develops. In fact, for a mold with an outside diameter $D_a$ of about 500 mm and an inside diameter $D_i$ of about 150 mm, and for a mold in which forms 29 are made of niobium are used, a temperature gradient corresponding to line 48 develops, which falls from an internal temperature of 800° C to an external temperature of 450° C. FIG. 4 thus. illustrates the synergistic effect of beating from the inside and the use of mold materials with a lower coefficient of thermal conductivity. The coefficient of thermal conductivity of copper is 408 W/mK, that of niobium only 53.7 W/mK, and that of tantalum, 57.5 W/mK, at room temperature in each case.

FIG. 5 shows an axial cross section through a valve, along the axis of which clearly visible hollow areas 49 and shrinkholes 50 have formed. FIG. 6 shows an analogous axial cross section through a valve which has been produced according to the process of the invention, which is described in greater detail below. The external surfaces of the shaft and valve plate are smooth and bare, and appropriate polished sections shows a very uniform grain size distribution and total freedom from voids, pores, shrinkholes, etc.

EXAMPLE

For the production of exhaust valves according to FIG. 6, which are intended for use in internal combustion engines, with a plate diameter of 32 mm, a total length of 110 mm (plate and shaft), and a shaft diameter of 6 mm, an apparatus according to FIG. 1 with a mold 15 according to FIGS. 2 and 3 was first evacuated to $10^{-2}$ bar and then flooded with argon up to a pressure of approximately 400 mbars. In melting and casting device 6, which was designed as a cold-wall crucible, 6 kg of a titanium alloy (titanium aluminide) of the composition 49% Ti, 47% Al, 2% Cu, and 2% Nb (atom-%), was melted and superheated to a temperature of 1,650° C. By means of heating device 20, which consisted of a hollow graphite cylinder slotted in such a way as to have the form of a meander, which was able to generate a power of 50 kW, and which w as inserted into in gate 19, the wall surfaces of gate 19 were heated over the course of 90 minutes to a temperature of 800° C. The outer ends of form halves 29*a*, 29*b*, made of niobium, i.e., the outer circumference $D_a$ of mold 15, thus assumed a temperature of 450° C. Over the course of approximately 2 seconds, the melt was now poured into mold 15, which was rotating at a speed of 800 rpm. After a few seconds, the valve blanks had solidified under the control-led conditions. Chamber 1 was then flooded with argon up to a pressure of approximately 1 bar. After 60 minutes, the valve blanks where freed by the stepwise disassembly of cooled mold 15 from top to bottom and by separating them from the material in gate 19. The valve blanks had a smooth and flawless surface. Longitudinal cross sections and polished cross sections showed that the valves were free of shrinkholes and porous areas and could be brought into their final state by simple finishing processes. Mold 15 and its various components were all in satisfactory condition and were suitable for reuse.

Whereas a centrifugal casting system in which centrifugal casting mold 15 has a vertical axis of rotation A—A has been described above, the apparatus according to the invention can also be modified, without leaving the scope of the invention, in such a way as to provide centrifugal casting mold 15 with a horizontal axis of rotation, although this is not shown specifically in the drawing. The effective coefficient of thermal conductivity of the mold materials or mold components in the radial direction is preferably no more than 50%, even more preferably no more than 30%, of the coefficient of thermal conductivity of pure copper.

LIST OF REFERENCE NUMBERS

1 chamber
2 jacket
3 cover
4 floor
5 suction connector
6 melting and casting device
7 tipping axis
8 loading opening
9 viewing window
10 viewing window
11 opening
12 cover plate

13 rotational drive
14 shaft
15 mold
16 support plate
17 thermal insulation
18 rotating table
19 gate
20 heating device
21 coupling piece
22 rod
23 rod
24 motion drive
25 double arrow
26 slide-through seal
27 connector pipe
28 flout guide
29 forms
29*a, b* form halves
30 shoulder surfaces
31 supports
32 spacer rings
33 tension rod
34 tension rod
35*a, b* clamping rings
36 valve body
37 pipe sections
38 openings
39 mold cavities
40 valves
40*a* plates
40*b* shaft
41 half-rings
42 half-rings
43 injection opening
44 arrows
45 line
46 line
47 line
48 line
49 voids
50 shrinkholes

What is claimed is:

1. An apparatus for precision casting of directional solidified castings, said apparatus comprising:

a melting and casting device having a closed chamber for creating a protective atmosphere of either vacuum or protective gases;

a rotatable mold supported in said chamber, said mold having a central gate and a plurality of mold cavities extending from the gate towards an outer circumference ($D_a$) of the mold, said mold having a rotary drive for creating centrifugal casting;

a heating device for preheating said mold, said heating device being relatively movable between a position within said gate and outside said gate and creating a temperature gradient falling from the gate towards said outer circumferences of the mold;

the mold being formed of a material or a material combination with a coefficient of thermal conductivity lower than that of copper;

a motion device for generating said relative motion of said heating device.

2. An apparatus according to claim 1, wherein the motion device has at least one rod which passes in a gas-tight manner through a slide-through seal in a cover of the chamber, said rod serving to supply heating current, and having an- external end connected to a motion drive.

3. An apparatus according to claim 1, wherein the heating device includes a resistance heating body which can be heated by the passage of current directly therethrough.

4. An apparatus according to claim 1, wherein the heating device includes an induction coil.

5. An apparatus according to claim 1, wherein the chamber has an opening, which is provided through a cover plate with a rotational drive and a shaft connected with the mold.

6. An apparatus according to claim 5, wherein the mold comprises a stack of forms arranged in several planes, said forms having shoulder surfaces, by means of which the forms are held by sector-shaped supports, the forms and the supports being arranged in each case in a plane between spacer rings, and the stack of forms, supports, and spacer rings being clamped by means of tension rod to a support plate connected in a torsion-proof manner to the rotational drive.

7. An apparatus according to claim 6, wherein the forms consist of form halves.

8. An apparatus according to claim 6, wherein the stack of foils, supports, and spacer rings is surrounded by a clamping body.

9. An apparatus according to claim 8, wherein the clamping body is made up of individual clamping rings which partially overlap each other in an axial direction.

10. An apparatus according to claim 9, wherein in that the upper clamping rings are designed with a Z-shaped cross section.

11. An apparatus according to claim 6, wherein a support plate is provided in the center of the gate with a distribution boded for the melt which tapers down in the upward direction.

12. An apparatus according to claim 1, wherein the gate is surrounded by mutually aligned sections of pipe, which are held in a central position by the spacer rings and have openings between the spacer rings, each of which communicates with one of the mold cavities.

13. An apparatus according to claim 12 wherein nozzle bodies assembled from half-rings for the entry of the melt into the mold cavities are arranged between the pipe sections and the forms.

14. The apparatus of claim 1, wherein said heating device can generate sufficient heat to heat the mold, starting from the gate, to a casting temperature sufficient for the material to be molded, at the walls of the gate, wherein the heating device can produce a temperature gradient of at least 100° C. and allows for a decrease in temperature from the inside toward the outside.

15. The apparatus of claim 1, wherein the mold cavities have ends with different cross sections, wherein the ends with the larger cross sections are arranged pointing toward the gate.

* * * * *